US006116012A

United States Patent [19]

Braun

[11] Patent Number: 6,116,012

[45] Date of Patent: Sep. 12, 2000

[54] SUPPORTING DISK FOR A SHAFT OF A ROTOR IN AN OPEN-END SPINNING MACHINE

[75] Inventor: Otmar Braun, Frielendorf, Germany

[73] Assignee: Firma Carl Freudenberg, Weinheim, Germany

[21] Appl. No.: 09/304,234

[22] Filed: May 3, 1999

Related U.S. Application Data

[62] Division of application No. 08/924,298, Sep. 25, 1997, abandoned, which is a continuation of application No. 08/805,709, Feb. 25, 1997, abandoned, which is a continuation of application No. 08/612,379, Mar. 7, 1996, abandoned.

[30] Foreign Application Priority Data

Mar. 25, 1995 [DE] Germany ..... 195 11 000

[51] Int. Cl.[7] ..... D01H 4/00

[52] U.S. Cl. ..... 57/406; 57/92; 57/104; 384/549

[58] Field of Search ..... 57/92, 103, 104, 57/105, 400, 404, 406, 407; 384/549

[56] References Cited

U.S. PATENT DOCUMENTS

| | | | |
|---|---|---|---|
| 4,676,673 | 6/1987 | Stahlecker | 57/103 |
| 4,713,932 | 12/1987 | Zott | 57/406 |
| 4,892,422 | 1/1990 | Stahlecker | 384/549 |
| 4,893,946 | 1/1990 | Tesh et al. | 57/103 |
| 4,896,976 | 1/1990 | Stahlecker | 384/549 |
| 5,221,133 | 6/1993 | Braun et al. | 384/549 |
| 5,362,160 | 11/1994 | Braun et al. | 384/549 |
| 5,423,616 | 6/1995 | Gotz | 384/549 |
| 5,509,262 | 4/1996 | Stahlecker | 57/406 |
| 5,517,814 | 5/1996 | Stahlecker | 384/549 |

FOREIGN PATENT DOCUMENTS

| | | |
|---|---|---|
| 32 05 566 | 8/1983 | Germany . |
| 36 15 777 | 11/1987 | Germany . |
| 41 02 142 | 7/1992 | Germany . |
| 41 21 387 | 1/1993 | Germany . |

*Primary Examiner*—William Stryjewski
*Attorney, Agent, or Firm*—Kenyon & Kenyon

[57] ABSTRACT

A supporting disk for a rotor of an open-end spinning machine comprising a hub ring made of metallic material and a support ring made of polymer material affixed to the outer circumferential surface of the hub ring, the outer circumferential surface of the hub ring engaging the inner circumferential surface of the support ring. The support ring extends beyond the hub ring in the axial direction on both sides with an equal projecting length.

6 Claims, 2 Drawing Sheets

SUPPORTING DISK FOR A SHAFT OF A ROTOR IN AN OPEN-END SPINNING MACHINE

This application is a divisional of prior U.S. patent application Ser. No. 08/924,298 filed Sep. 25, 1997, now abandoned, which is a continuation of U.S. patent application Ser. No. 08/805,709, filed Feb. 25, 1997, now abandoned, which is a continuation of U.S. patent application Ser. No. 08/612,379, filed Mar. 7, 1996, now abandoned.

BACKGROUND OF THE INVENTION

The invention relates to a supporting disk for a rotor of an open-end spinning machine comprising a hub ring made of metallic material and a support ring made of polymer material, the support ring being affixed to the outer circumferential surface of the hub ring, the inner circumferential surface of the support ring and the outer circumferential surface of the hub ring being in interlocking engagement.

Such a supporting disk is known from the German Patent DE 36 15 777 A1, which corresponds to U.S. Pat. No. 4,713,932, incorporated herein by reference. The outer circumferential surface of the support ring in that reference is constructed as a smooth, uninterrupted, essentially cylindrical bearing surface; the inner circumferential surface of the support ring in that reference has a profile by which the thickness of the support ring is reduced in the middle area as compared to the edge areas. This is said to avoid undesirably high heating in the middle region of the support ring, even during heavy stress.

In such a supporting ring, however, because the axial end faces of the hub ring and the support ring are arranged in the same radial plane, the end faces of the support ring and the hub ring are both worn by excessive turning. To be sure, if the support ring is worn out it can be chemically detached from the hub ring; however, continually replacing the worn out support ring with a new support ring is not possible because the hub ring is also continually worn, and, therefore, with an increasing number of support ring replacements, the hub ring would have an increasingly smaller width in the axial direction.

SUMMARY OF THE INVENTION

An object of the present invention is to develop an improved supporting disk so that a hub ring comprising a metallic material can be covered with new support rings as needed and so that the geometrical dimensions of the supporting disk are retained unaltered. A further object of the present invention is to develop a supporting disk with improved working properties as compared to previously known designs.

The above objectives may be achieved by the design of a supporting disk in which the support ring extends beyond the hub ring in the axial direction on both sides with substantially equal projecting lengths. With this arrangement, excessive wear on the end faces of the hub ring is reduced or eliminated, so that the hub ring may be repeatedly reused with replacement support rings. A further advantage from an economic and technical engineering standpoint is that such a supporting disk can be produced simply and cost-effectively.

In accordance with one embodiment of the invention, the amount by which the support ring extends beyond the hub ring in the axial direction may be, for example, a maximum of 0.5 mm on each side. Depending on the dimensions of the supporting disk, the ratio of the sum of both axial projecting lengths to the axial width of the outer circumferential surface of the hub ring may be, for example, 0.01 to 0.5. Because of the small projecting lengths, the danger of imbalances and wobble motions is reduced.

The hub ring may be made of a metallic material and the support ring may be joined to the hub ring by means of a mechanical claw-like engagement. With a metallic hub ring, the possibility of an imbalance occurring on account of manufacture has a less serious effect because of the comparatively greater mass of the hub ring, as compared to the case of hub rings which comprise a relatively lighter polymer material.

The hub ring may have end faces on both sides in the axial direction which having self-contained annular grooves running in the circumferential direction, the annular grooves being constructed for engagement with congruently shaped projections of the support ring. In this manner, the entire radially exterior area of the hub ring is surrounded by the support ring. Because—viewed in the axial direction—the hub ring and the support ring are mechanically joined to each other with a claw fixation in the area of their end faces, as opposed to in the center, the engagement between the two parts is particularly durable, even when, for example, an axial force acts on the support ring because of thermal expansion of the components being supported.

The support ring may have a substantially U-shaped profile open radially to the inside which completely surrounds the outer circumferential surface of the hub ring in a clamp-like manner. This helps prevent impurities and/or moisture from entering between the hub ring and the support ring. An additional adhesive may be used, which results in an especially durable engagement. The U-shaped profile results in an enlarged area of contact between the hub ring and the support ring, which increases the engagement of the two rings to one another. Deformation of the support ring caused by centrifugal force can be effectively reduced in this manner.

The hub ring may have at least one circumferential groove on its outer circumferential surface having an essentially bell-shaped curve type of profile, and the groove may be completely filled in by the polymer material of the support ring. Preferably the circumferential groove has a radial depth from the outer circumferential surface which corresponds at least to the radial distance of the annular grooves from the outer circumferential surface of the hub ring. Because of the bell-shaped curve type of profile, the support ring is centered on the hub ring during formation. In addition, because of the bell-shaped curve type of projection, the support ring is better able to absorb axial forces, as such forces do not have to be absorbed by the projections alone.

The hub ring may be joined to a light reflecting signal transmitter on at least one of its end faces, the signal transmitter being formed by a foil joined adhesively to the hub ring. The signal transmitter enables a monitoring of the rotational speed of the supporting disk in a particularly simple manner, by, for example, a signal sensor connected via a control device to the driving mechanism of the supporting disk. The foil may simply be cemented on the end face of the hub ring. The use of a foil is advantageous in reducing the materials cost of manufacturing the supporting disk, as compared to the use of a reflector made of plastic. Furthermore, the use of a pasted-on reflector-foil reduces the danger of producing additional imbalances.

The foil may be flush with the surface of the end face of the hub ring. In this manner, the foil is held safely in its position even when the supporting disk is rotating with high rotational speed subjecting the foil to correspondingly large centrifugal forces. Retaining the foil in this manner helps insure a precise transmission of the pulses to detect the rotational speed of the supporting disk.

The durability of the polymer support ring may be improved by providing at least one of the projecting lengths with cooling ribs extending substantially in the radial direction, the cooling ribs having a maximum axial depth corresponding to the size of the projecting length in the same direction. The cooling ribs help cool the support ring itself as well as the surface of the structural element to be supported. The cooling ribs may be constructed substantially impeller-shaped to assure the highest rate of air flow possible. Especially given high rotational speeds for example above 100,000 revolutions/min, the cooling ribs, preferably distributed uniformly in the circumferential direction, increase the useful life by at least 30% in comparison to a support ring whose end faces are constructed smoothly and are arranged in a radial plane with the end faces of the hub ring. In comparison with cooling grooves which extend substantially in the center of the outer circumferential surface of the support ring, the cooling ribs molded into the support ring in the above-described manner are advantageous in that the thickness of the support ring covering the bearing surface is reduced, contributing to a thermal relieving in the middle bearing surface area.

DETAILED DESCRIPTION OF THE DRAWINGS

Figure 1:
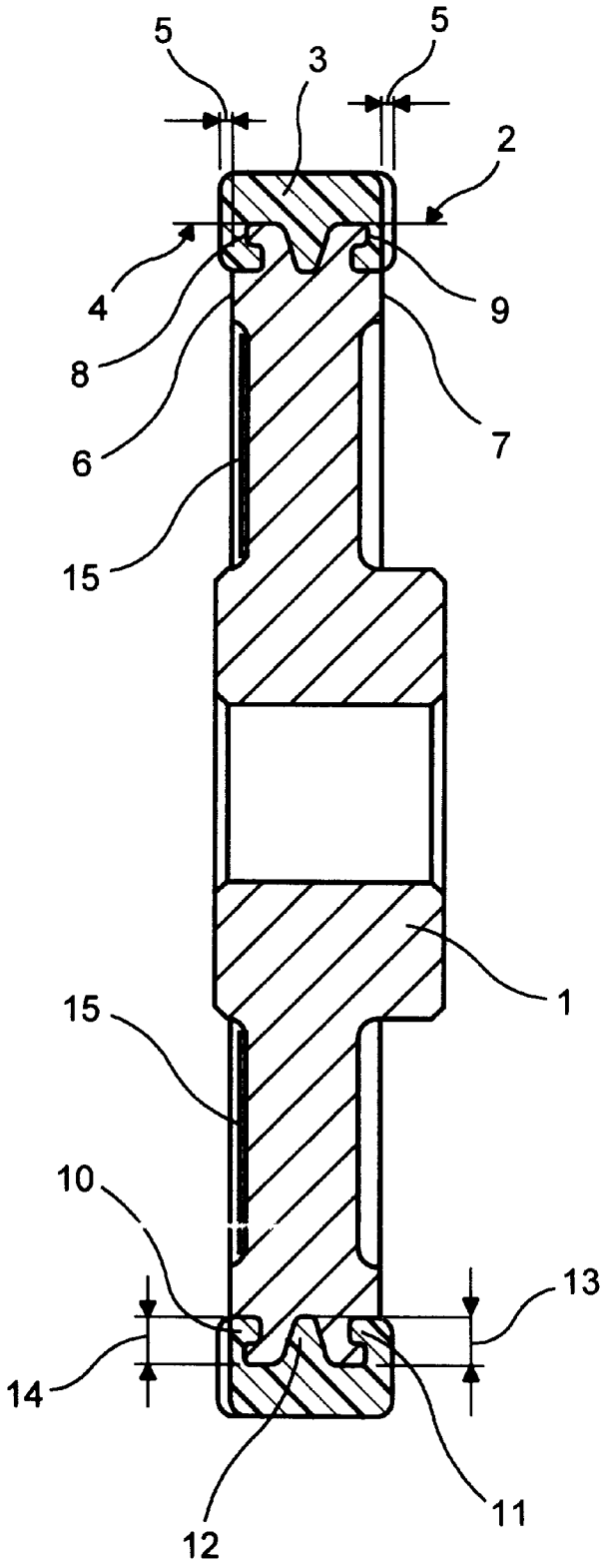
FIG. 1 shows a cross-section through an exemplary embodiment of a supporting disk according to the invention.
Figure 2:
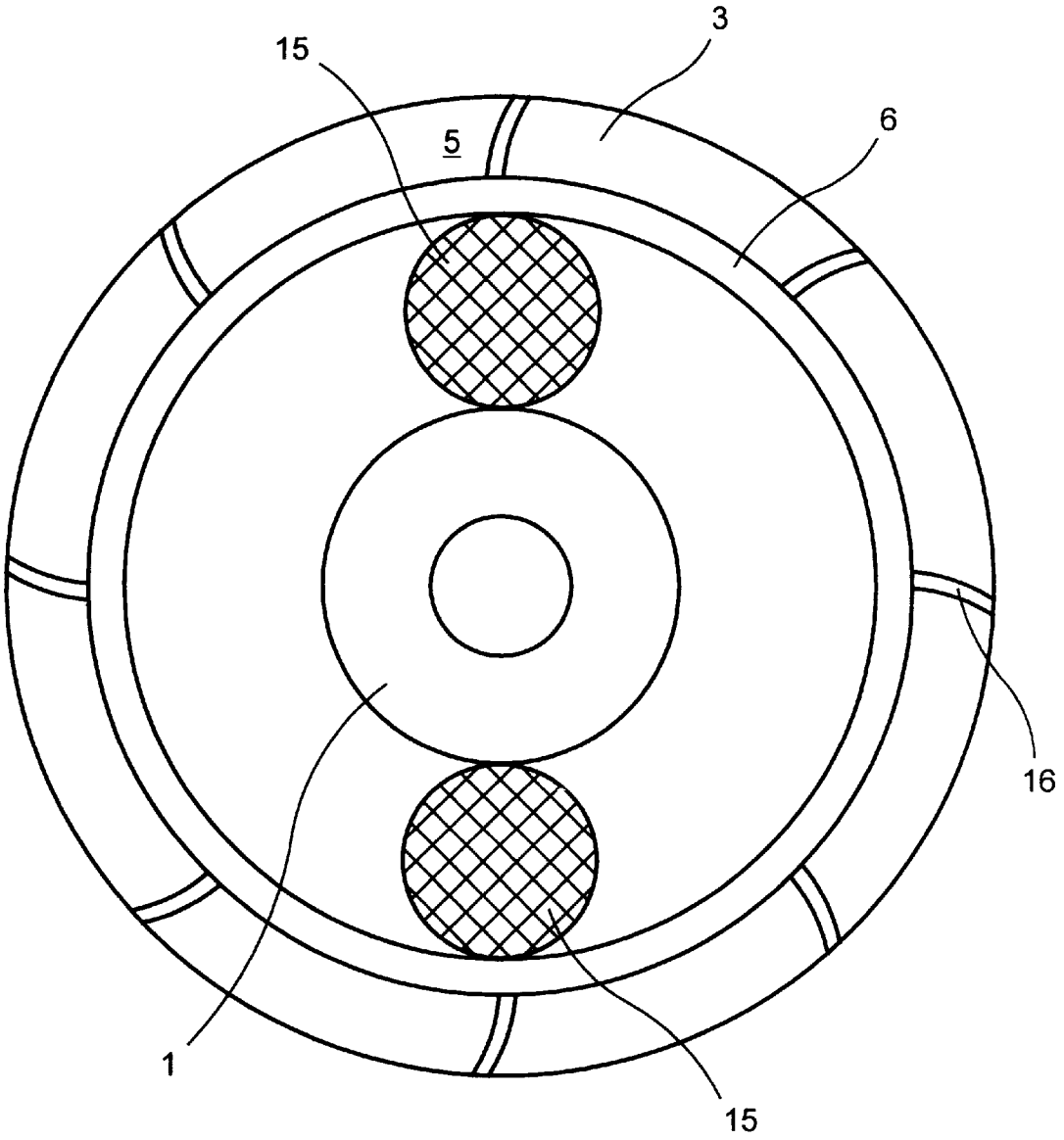
FIG. 2 shows another view of the supporting disk shown in FIG. 1.

FIGS. 1 and 2 show an exemplary embodiment of a supporting disk according to the invention for a rotor of an open-end spinning machine. The supporting disk comprises a hub ring 1 made of metallic material and a support ring 3 made of polymer material. The inner circumferential surface 4 of the support ring 3 and the outer circumferential surface 2 of the hub ring 1 are engaged. The support ring 3 extends beyond the hub ring 1 in the axial direction on both sides with in each case a projecting length 5. In the illustrated example, the axially projecting length 5 amounts in each case to 0.1 mm.

The support ring 3 embraces the hub ring 1 in its radially outer area. Bulbous projections 10, 11 of the support ring 3 engage corresponding annular grooves 8, 9 in the end faces 6, 7 of the hub ring 1.

The hub ring 1 has a centrically arranged groove 12 having a bell-shaped curve type of profile which is completely filled in by polymer material of the support ring 3. The radial depth 13 of the groove 12 corresponds to the radial distance 14 of the annular grooves 8, 9 from the outer circumferential surface 2 of the hub ring 1.

One of the end faces 6 of the supporting disk has a signal transmitter 15 formed by a foil, which reflects light to allow detection of the rotational speed of the supporting disk. The foil is cemented in place in the end face 6 of the hub ring 1, aligned flush with the surface.

The wall bordering the bore hole of the hub ring 1 is compacted by means of a machining process, for example rolling, to assure a reliable pressure against a ball bearing pin. This insures excellent concentrical and transverse rotary running.

In FIG. 2, it can be seen that the signal transmitters 15 are distributed uniformly over the circumference of the supporting disk. The cooling ribs 16 shown in FIG. 2, which are arranged in the projecting lengths 5, are impeller-shaped and extend substantially in the radial direction. The cooling ribs 16 are molded in one operation when pressing the support ring 3 onto the hub ring 1. The cooling ribs 16 dispense with the need for a cooling groove in the outer circumferential surface of the support ring 3. The cooling ribs 16 prolong the useful life of the supporting disk, since the polymer material of the support ring 3 is subjected to only comparatively low thermal stress.

What is claimed is:

1. A supporting disk for a shaft of a rotor of an open-end spinning machine comprising a hub ring comprised of a metallic material and a support ring comprised of a polymer material;

wherein an inner circumferential surface of the support ring engages an outer circumferential surface of the hub ring;

wherein the support ring extends beyond the hub ring in a direction parallel to an axis of rotation on both sides with substantially equal projecting lengths on each side; and wherein at least one of the projecting lengths has cooling ribs extending substantially in the radial direction and wherein the cooling ribs have a maximum depth which substantially corresponds to the projecting length.

2. A supporting disk according to claim 1, wherein the ratio of the sum of both axial projecting lengths to the axial width of the outer circumferential surface of the hub ring is 0.01 to 0.5.

3. A supporting disk according to claim 1, wherein the support ring has an essentially U-shaped profile open radially to the inside which completely surrounds the outer circumferential surface of the hub ring in a clamp-like manner.

4. A supporting disk according to claim 1, wherein the hub ring has end faces on both sides in the axial direction having self-contained annular grooves running in the circumferential direction, wherein the annular grooves are constructed to engage congruently shaped projections of the support ring.

5. A supporting disk according to claim 1, further comprising at least one signal transmitter joined to an end face of the hub ring, wherein the signal transmitter comprises a foil joined adhesively to the hub ring for reflecting light.

6. A supporting disk according to claim 5, wherein the foil is flush with a surface of the end face of the hub ring.

* * * * *